US011818825B2

(12) United States Patent
Kitano et al.

(10) Patent No.: US 11,818,825 B2
(45) Date of Patent: Nov. 14, 2023

(54) INDUCTION HEATED ROLL APPARATUS

(71) Applicant: TOKUDEN CO., LTD., Kyoto (JP)

(72) Inventors: Takatsugu Kitano, Otsu (JP); Kozo Okamoto, Takashima (JP)

(73) Assignee: TOKUDEN CO., LTD., Kyoto (JP)

( * ) Notice: Subject to any disclaimer, the term of this patent is extended or adjusted under 35 U.S.C. 154(b) by 390 days.

(21) Appl. No.: 17/125,471

(22) Filed: Dec. 17, 2020

(65) Prior Publication Data

US 2021/0195704 A1 Jun. 24, 2021

(30) Foreign Application Priority Data

Dec. 20, 2019 (JP) ..... 2019-230398

(51) Int. Cl.
*H05B 6/42* (2006.01)
*H05B 6/06* (2006.01)
*H05B 6/14* (2006.01)

(52) U.S. Cl.
CPC ..... *H05B 6/42* (2013.01); *H05B 6/06* (2013.01); *H05B 6/145* (2013.01)

(58) Field of Classification Search
CPC ..... H05B 6/06; H05B 6/145; H05B 6/42
See application file for complete search history.

(56) References Cited

U.S. PATENT DOCUMENTS

2004/0118894 A1* 6/2004 Koch ..... F16C 32/044 226/188
2018/0235036 A1* 8/2018 Kitano ..... H05B 6/145

FOREIGN PATENT DOCUMENTS

| | | | |
|---|---|---|---|
| DE | 112010003915 | T5 | 11/2012 |
| EP | 1403607 | A2 | 3/2004 |
| EP | 3361829 | A1 | 8/2018 |
| JP | S57136955 | U | 8/1982 |
| JP | 2000297328 | A | 10/2000 |
| JP | 2002319480 | A | 10/2002 |
| JP | 2011108399 | A | 6/2011 |
| JP | 2016024932 | A | 2/2016 |
| JP | 2019075357 | A | 5/2019 |

OTHER PUBLICATIONS

European Patent Office, Extended European Search Report Issued in Application No. 20215604.8, dated May 11, 2021, Germany, 6 pages.
Japan Patent Office, Office Action Issued in Application No. 2019230398, dated Jun. 20, 2023, 8 pages.

* cited by examiner

*Primary Examiner* — Dana Ross
*Assistant Examiner* — Joe E Mills, Jr.
(74) *Attorney, Agent, or Firm* — Alleman Hall Creasman & Tuttle LLP

(57) ABSTRACT

An induction heated roll apparatus includes a roller main body, an induction heating mechanism, and a cooling mechanism. The induction heating mechanism heats the roller main body, while the cooling mechanism cools the roller main body and/or the induction heating mechanism using a cavity portion between the roller main body and the induction heating mechanism. The cooling mechanism has intake apertures and discharge apertures that are formed in a journal flange portion and communicate with the cavity portion, a suction mechanism that suctions a gas in the cavity portion through the discharge apertures, and a mist supply mechanism that supplies mist to the intake apertures.

6 Claims, 8 Drawing Sheets

INDUCTION HEATED ROLL APPARATUS

TECHNICAL FIELD

The present invention relates to an induction heated roll apparatus.

TECHNICAL BACKGROUND

In a continuous heat treatment process and the like performed, for example, on a sheet material such as plastic film, paper, cloth, non-woven cloth, synthetic fiber, or metal foil and the like, or on a continuous material such as a webbing material or a wire (i.e., thread) material and the like, an induction heated roll apparatus is used in which an induction heating mechanism is disposed inside a roller main body that is able to rotate, and this induction heating mechanism causes circumferential wall portions of the roller main body to emit heat using an induced current.

In recent years, there has been an increasing demand for technology that enables the heating temperature of a roller main body to be altered in a short time period when, for example, the type of continuous material is altered. Moreover, from the standpoints of health and safety, if the temperature of the roller main body is not reduced to a fixed temperature or lower after the heat treatment process has ended, then the person operating the induction heated roll apparatus is not able to leave the worksite. For these reasons, it is necessary that the roller main body be cooled in as short a time as possible.

As is described in Patent Document 1, one apparatus that might be considered for cooling the roller main body is an air-cooling apparatus that cools the roller main body by suctioning gas from a cavity portion between the roller main body and the induction heating mechanism. More specifically, this roller apparatus is formed such that air intake apertures are formed in a first journal flange portion on a first end side in an axial direction of the roller main body, and air discharge apertures are formed in a second journal shaft portion on a second end side in the axial direction of the roller main body, and gas in the cavity portion is suctioned out through the air discharge apertures. By employing this structure, the gas flowing into the cavity portion through the air intake apertures flows between a shell portion of the roller main body and the induction heating mechanism, and then flows between the journal shaft portion of the roller main body and a supporting shaft of the induction heating mechanism. From there the gas is discharged through the air discharge apertures to the outside.

In contrast, as is described in Patent Document 2, another apparatus that might be considered is an apparatus in which a cooling medium inflow path is formed in a supporting shaft that supports a circular-cylinder shaped iron core of an induction heating mechanism, and an atomized cooling medium is introduced through the cooling medium inflow path into a gap portion (i.e., a cavity portion) between the roller main body and the induction heating mechanism.

CITATION LIST

Patent Documents

Patent Document 1
Japanese Unexamined Patent Application (JP-A) No. 2019-75357

Patent Document 2
Japanese Unexamined Patent Application (JP-A) No. 2011-108399

SUMMARY OF THE INVENTION

Problems to be Solved by the Invention

In the structure disclosed in Patent Document 1, the cavity between the journal shaft portions of the roller main body and the supporting shaft of the induction heating mechanism is smaller than the cavity between the shell portion of the roller main body and the induction heating mechanism. Because of this, a reduction in the gas flow rate is brought about by pressure loss in the cavity between the journal shaft portion of the roller main body and the supporting shaft of the induction heating mechanism, so that it becomes difficult to improve the cooling performance.

More specifically, an outer diameter of the journal shaft portions depends on specifications input by a user, and there is a tendency for the outer diameter of the journal shafts portion to be narrower irrespective of the outer diameter of the shell portion of the roller main body. In addition, an inner diameter of the journal shaft portions is set so that a constant thickness is maintained between this inner diameter and the outer diameter of the journal shaft portions. Moreover, an outer diameter of the supporting shaft of the induction heating mechanism that is inserted through an interior of the journal shaft portions is determined by a cross-sectional area and the like of wiring that supplies power to the induction heating mechanism. Furthermore, these factors also determine the cross-sectional area (i.e., the conduction cross-sectional area) of the cavity between the journal shaft portions and the supporting shaft of the induction heating mechanism. Irrespective of the fact that the object being cooled is the shell portion of the roller main body, limitations are imposed on the cooling thereof by the cavity between the journal shaft portions and the supporting shaft of the induction heating mechanism. In particular, if the width and/or length of the shell portion of the roller main body are increased, then the mass (i.e., the thermal capacity) thereof also increases, requiring a large-scale cooling capacity. However, it is difficult to achieve such a large-scale cooling capacity due to the limitations imposed by the size of the cavity between the journal shaft portions and the supporting shaft of the induction heating mechanism.

Moreover, in the structure disclosed in Patent Document 2, because an atomized cooling medium is introduced via the interior of the supporting shaft of the induction heating mechanism, there is a possibility that the atomized cooling medium will become warmed and consequently vaporized before reaching the shell portion of the roller main body. If this occurs, then the cooling medium is unable to efficiently capture vaporization latent heat from the shell portion of the roller main body, and it becomes difficult to achieve a large-scale cooling capacity.

The present invention was therefore conceived in order to solve the above-described problems, and it is a principal object thereof to enable an improved cooling performance to be achieved in a structure that uniformly cools a roller main body and/or an induction heating mechanism by means of a gas.

Means for Solving the Problem

In other words, the induction heated roll apparatus according to the present invention is provided with a roller main body having a hollow portion, an induction heating mechanism that is provided inside the hollow portion, and that performs induction heating on the roller main body, and a cooling mechanism that cools the roller main body and/or the induction heating mechanism using a cavity portion between the roller main body and the induction heating mechanism, wherein the cooling mechanism is provided with an intake aperture that is formed on a first end side in an axial direction of the roller main body and communicate with the cavity portion, a discharge aperture that is formed on a second end side in the axial direction of the roller main body and communicate with the cavity portion, a suction mechanism that suctions a gas in the cavity portion through the discharge aperture, and a mist supply mechanism that supplies mist to the intake aperture, and wherein the intake aperture is formed in a first journal flange portion on the first end side in the axial direction of the roller main body, and the discharge aperture is formed in a second journal flange portion on the second end side in the axial direction of the roller main body.

According to the induction heated roller apparatus of the present invention, because an intake aperture is formed in a first journal flange portion on the first end side in the axial direction of a roller main body, gas that is introduced via the intake aperture flows through the intake aperture into a cavity portion at a first end portion in the axial direction of the roller main body without passing through a cavity between a first journal shaft portion of the roller main body and a supporting shaft of an induction heating mechanism. In addition, because discharge aperture to which a suction mechanism is connected is formed in a second journal flange portion on the second end side in the axial direction of the roller main body, the gas flowing in through the intake aperture is discharged to the outside via the discharge aperture at a second end portion in the axial direction of the roller main body without passing through the cavity between the second journal shaft portion of the roller main body and the supporting shaft of the induction heating mechanism. Consequently, at both end portions in the axial direction of the roller main body, no limitations are imposed by pressure loss in the cavity between the respective journal shaft portion of the roller main body and the supporting shaft of the induction heating mechanism. As a result, it is possible to increase the flow rate of a gas flowing through the cavity portion, and to thereby improve the cooling performance.

Moreover, according to the induction heated roll apparatus of the present invention, because mist is supplied to the intake apertures formed in the first journal flange portion, it is possible to shorten the route that the mist travels in order to reach a shell portion of the roller main body, and to thereby introduce the mist extremely efficiently to the shell portion of the roller main body. As a result, by raising the humidity of the gas flowing in through the intake aperture, it is possible to greatly improve the specific heat of the gas, and to also capture the vaporization latent heat from the shell portion of the roller main body extremely efficiently, so that the cooling performance is improved as a consequence.

In addition, according to the present invention, because high-temperature gas that is heated as a result of flowing through the cavity portion does not pass through the cavity between the journal shaft portions of the roller main body and the supporting shaft of the induction heating mechanism, this high-temperature gas is prevented from coming into contact with the bearing provided on the journal shaft portions, so that any reduction in the remaining lifespan of the bearing is inhibited.

The roller main body has a circular-cylinder shaped shell portion, and two journal portions, with each journal portion being connected to a respective end portion in the axial direction of the shell portion. Moreover, in order to obtain a cooling effect on the roller main body and the like, and temperature uniformity in a circumferential direction of the roller main body, it is desirable that the gas flowing through the cavity portion flows at a uniform flow velocity in the circumferential direction. In order to achieve this, it is desirable that the intake aperture be one of a plurality of intake apertures formed in the first journal flange portion, and/or that the discharge aperture be one of a plurality of discharge apertures formed in the second journal flange portion. By providing a plurality of intake apertures and/or discharge apertures, it is possible, while maintaining the mechanical strength of the journal portion and also lowering fluid resistance, to supply a flow of gas and mist evenly in the circumferential direction of the cavity portion.

Because the intake apertures are provided on the roller main body side, they do rotate; however, because the mist supply mechanism is provided on the stationary side, it does not rotate. As a specific embodiment of the mist supply mechanism that is used to supply mist to the rotating intake apertures, it is desirable that the mist supply mechanism be provided with a header portion that is provided in such a way as to cover the intake apertures on the stationary side, and with a mist generating device that is provided in the header portion.

By providing the header portion, there is a possibility that gas suction resistance will increase. For this reason, it is desirable that the header portion be provided with an outside air intake aperture that enables outside air to be introduced into a header space in the header portion.

In order to ensure that the mist does not leak to the outside of the header portion, it is desirable that the mist supply mechanism be further provided with a rotary sealing mechanism that is interposed between the header portion and the first journal flange portion, and seals the header space off from the outside air in portions other than the outside air intake aperture.

As a specific supporting structure of the header portion, it is desirable that the header portion be supported via a bearing so as to be stationary on an outer-side circumferential surface of the journal shaft portion of the roller main body.

As another specific supporting structure of the header portion, it is desirable that the header portion be supported so as to be stationary by being fixed to a stationary structural component that is provided separately from the roller main body.

The quantity of cooling heat in the roller main body and the time required for the cooling are in a proportional relationship with the flow velocity, in other words, with the flow rate of the gas. Namely, if the flow rate of the gas inside the cavity portion is increased, then the quantity of cooling heat increases, and the time required for cooling is shortened. However, during a load operation, because the required amount of cooling varies depending on amount of heat generated by the load and on the operating conditions, it is desirable that the cooling mechanism adjust the flow rate of the gas flowing through the cavity portion in accordance therewith. According to this structure, it is possible to efficiently adjust the roller main body to a predetermined temperature.

In order to prevent a cooling medium from forming condensation and dew inside the roller main body, and to thereby improve the cooling performance, it is desirable that there be further provided a temperature sensor that detects a temperature of a minimum temperature portion of an internal portion of the roller main body, and that the mist supply mechanism adjust a supply rate of the mist such that a dew point temperature of wet gas in the cavity portion does not drop below the temperature of the minimum temperature portion.

Effects of the Invention

According to the present invention which is formed in the above-described manner, in a structure in which a roller main body and/or an induction heating mechanism are cooled uniformly by a gas, it is possible to improve the cooling performance thereof.

BEST EMBODIMENTS FOR IMPLEMENTING THE INVENTION

An induction heated roll apparatus 100 according to an embodiment of the present invention is used in a continuous heat treatment process and the like performed, for example, on a sheet material such as plastic film, paper, cloth, non-woven cloth, synthetic fiber, or metal foil and the like, or on a continuous material such as a webbing material or a wire (i.e., thread) material and the like.

Apparatus Structure

Figure 1:
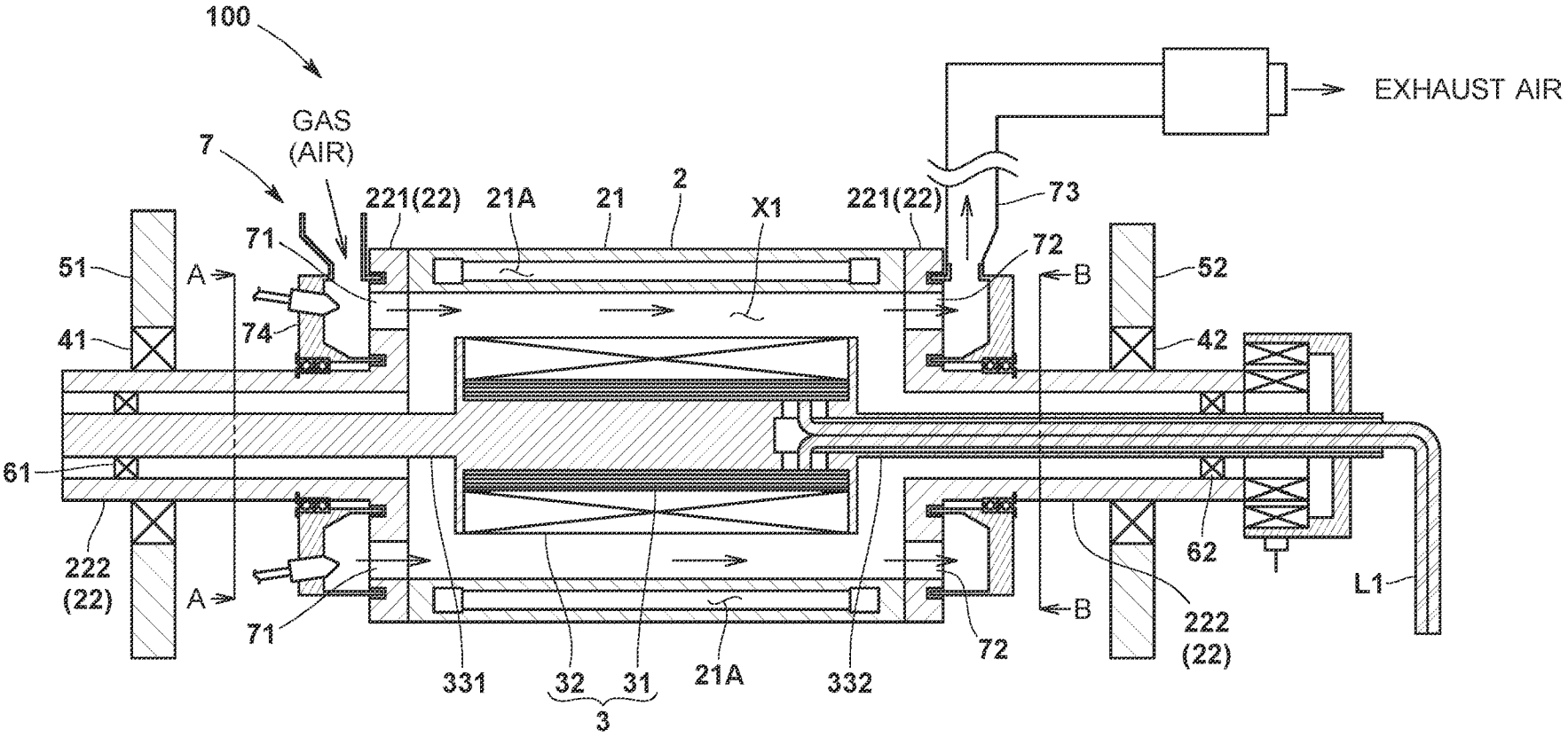
FIG. 1 is a cross-sectional view schematically showing a structure of an induction heated roll apparatus of an embodiment of the present invention.

As is shown in FIG. 1, the induction heated roll apparatus 100 of the present embodiment is provided with a hollow circular-cylinder shaped roller main body that is supported so as to be able to rotate freely, and an induction heating mechanism 3 that is disposed in a stationary state inside the hollow portion of the roller main body 2.

The roller main body 2 is provided with a shell portion 21 formed in a circular-cylinder shape, and two journal portions 22, with one journal portion being provided at each respective end portion of the shell portion 21. Each journal portion 22 has a journal flange portion 221 that covers an end-portion aperture of the shell portion 21, and a journal shaft portion 22 that is hollow and is formed integrally with the relevant journal flange portion 221. In addition, journal shaft portions 222 are supported via bearings 41 and 42 such as rolling bearings or the like so as to be able to rotate freely in stands 51 and 52. The roller main body 2 is formed so as to be able to be rotated by drive force supplied from the outside by a rotation drive mechanism (not shown in the drawings) such as, for example, a motor.

A plurality of jacket chambers 21A that extend in a longitudinal direction (i.e., in an axial direction) and inside which is sealed a gas-liquid two-phase heating medium are formed in the shell portion 21 of the roller main body 2 at intervals (for example, substantially equidistantly) over the entire circumferential direction thereof. A surface temperature of the shell portion 21 is kept uniform by latent heat movement of the gas-liquid two-phase heating medium sealed inside the jacket chambers 21A.

The induction heating mechanism 3 has a circular-cylinder shaped steel core 31 that is formed in the shape of a circular cylinder, an induction coil 32 that is wrapped around an outer-side circumferential surface of the circular-cylinder shaped steel core 31, and supporting shafts 331 and 332 that support the circular-cylinder shaped steel core 31 and induction coil 32. One of the supporting shafts 331 and 332 is provided respectively at each of the two ends of the circular-cylinder shaped steel core 31. The supporting shafts 331 and 332 are each inserted inside the interior of one of the journal shaft portions 222, and are supported via bearings 61 and 62 such as rolling bearings or the like so as to be able to rotate freely relative to their respective journal shaft portions 222. As a result, the induction heating mechanism 3 is held inside the interior of the rotating roller main body 2 in a stationary state relative to the roller main body 2. A lead wire L1 is connected to the induction coil 32, and an AC power supply (not shown in the drawings) that is used to supply AC voltage is connected via a power regulator (not shown in the drawings) to the lead wire L1.

When AC voltage is supplied to the induction coil 32, alternating magnetic flux is generated by the above-described induction heating mechanism 3, and this alternating magnetic flux is transmitted through the shell portion 21 of the roller main body 2. As a result of this transmission of the alternating magnetic flux, an induced current is generated in the shell portion 21, and joule heat is generated in the shell portion 21 by this induced current.

Cooling Mechanism 7 of the Induction Heated Roll Apparatus 100

As is shown in FIG. 1, the induction heated roll apparatus 100 of the present embodiment is also provided with a cooling mechanism 7 that cools the roller main body 2 and the induction heating mechanism 3 using a cavity portion X1 between the roller main body 2 and the induction heating mechanism 3.

This cooling mechanism 7 cools the roller main body 2 and the induction heating mechanism 3 by generating a gas flow in the cavity portion X1. Note that the gas used in the present embodiment is air, which is an atmospheric gas present in the space where the roller main body 2 is installed; however, by using, for example, nitrogen gas or the like as the atmospheric gas instead of air, it is also possible for nitrogen gas or the like to be used as the gas.

More specifically, as is shown in FIG. 1, the cooling mechanism 7 introduces external gas from outside the roller main body 2 into the cavity portion X1, which is formed in a substantially circular cylinder shape between the roller main body 2 and the induction heating mechanism 3, through a first end portion in the axial direction thereof, and also cools the roller main body 2 and the induction heating mechanism 3 by discharging this same gas from a second end portion in the axial direction of the cavity portion X1.

Note that, as is indicated by arrows in FIG. 1, this axial direction is seen as a left-right direction when looking at the drawing.

More specifically, the cooling mechanism 7 is provided with intake apertures (i.e., air intake apertures) 71 that are formed in the roller main body 2 at a first end side in the axial direction thereof and communicate with the cavity portion X1, discharge apertures (i.e., air discharge apertures) 72 that are formed in the roller main body 2 at a second end side in the axial direction thereof and communicate with the cavity portion X1, a suction mechanism 73 that is connected to the discharge aperture 72 and suctions the gas inside the cavity portion X1 out through the discharge apertures 72, and a mist supply mechanism 74 that supplies mist to the intake apertures 71.

Figure 2:
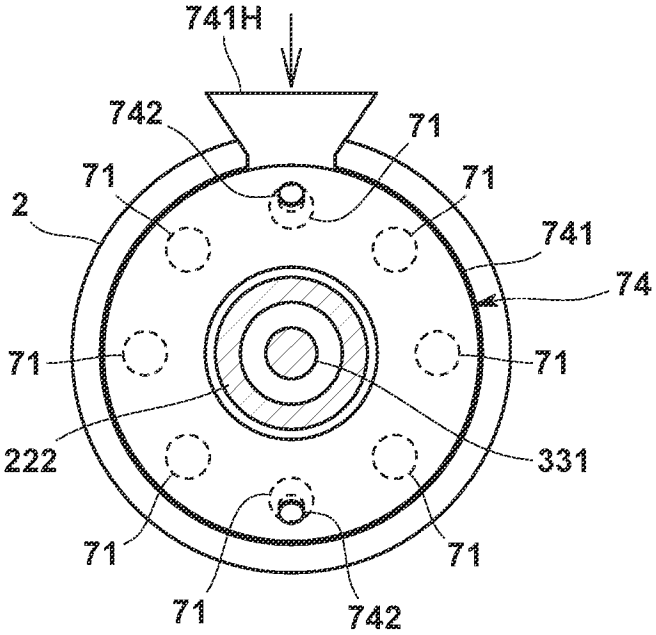
FIG. 2 is a cross-sectional view taken along a line A-A showing a structure of intake apertures of the same embodiment.

The intake apertures 71 enable external gas from outside the roller main body 2 to be introduced into the interior of the cavity portion X1 and, as is shown in FIG. 2, a plurality of the intake apertures 71 are formed in the journal flange portion 221 at the first end side in the axial direction. Moreover, the intake apertures 71 are formed, for example, substantially equidistantly in the circumferential direction in the journal flange portion 221 at the first end side in the axial direction. Each intake aperture 71 is formed by a through hole that is formed in the journal flange portion 221 so as to extend in the axial direction thereof. The shape of the aperture of each intake aperture 71 of the present embodiment is circular; however, it is possible for a variety of shapes to be used instead of this shape such as an elongated hole shape, an elliptical shape, a rectangular shape, or a polygonal shape or the like.

Figure 3:
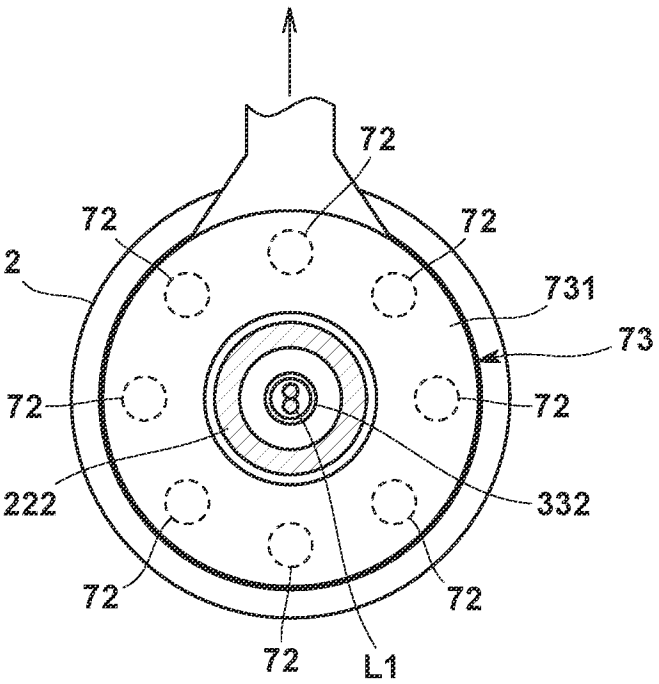
FIG. 3 is a cross-sectional view taken along a line B-B showing a structure of discharge apertures of the same embodiment.

The discharge apertures 72 enable the gas inside the cavity portion X1 to be discharged to the outside of the roller main body 2 and, as is shown in FIG. 3, a plurality of the discharge apertures 72 are formed in the journal flange portion 221 at the other side in the axial direction. Moreover, the discharge apertures 72 are formed, for example, substantially equidistantly in the circumferential direction in the journal flange portion 221 at the second end side in the axial direction. Each discharge aperture 72 is formed by a through hole that is formed in the journal flange portion 221 so as to extend in the axial direction thereof. The shape of the aperture of each discharge aperture 72 of the present embodiment is circular; however, it is possible for a variety of shapes to be used instead of this shape such as an elongated hole shape, an elliptical shape, a rectangular shape, or a polygonal shape or the like.

Figure 4:
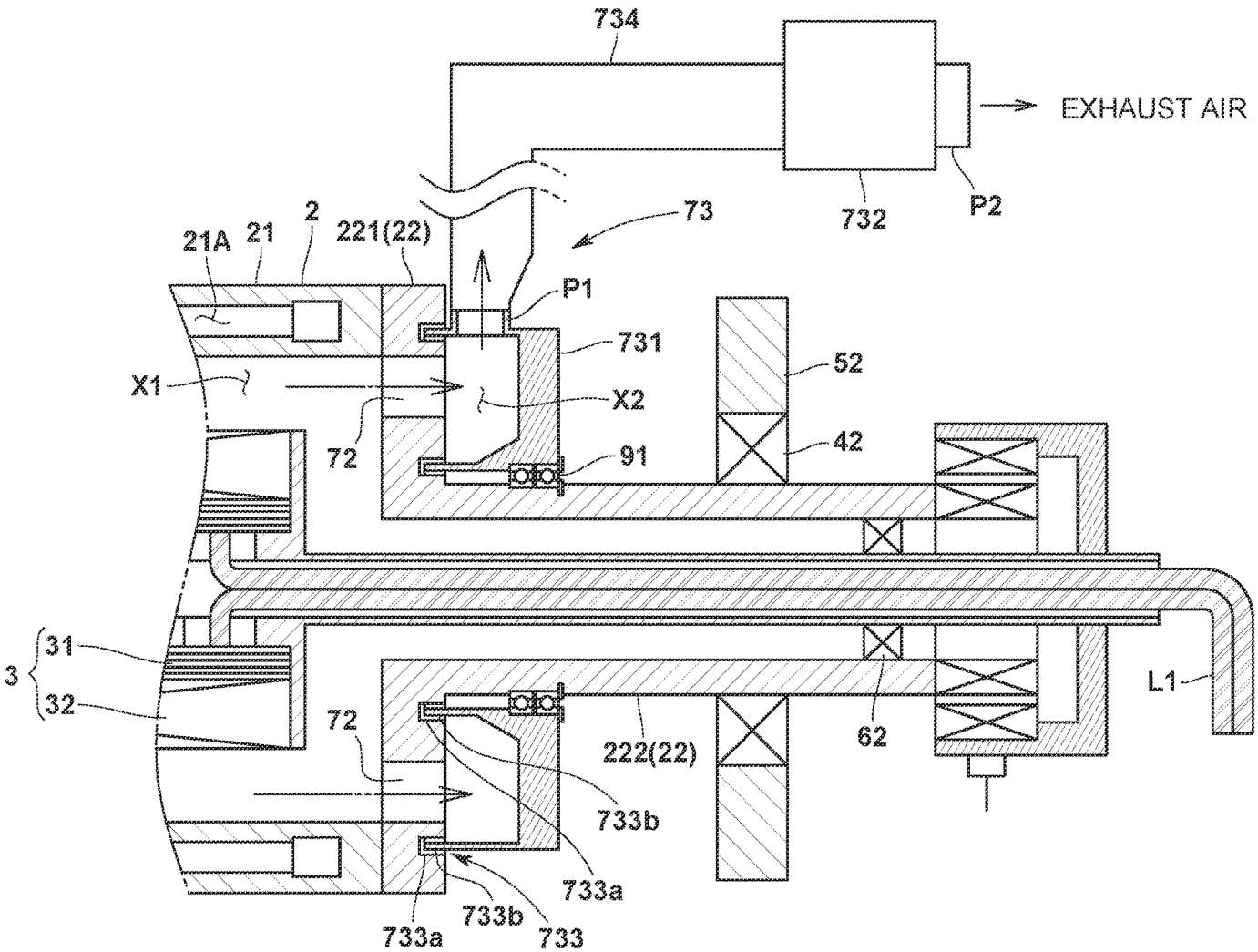
FIG. 4 is a cross-sectional view showing a structure of a second end side (i.e., a suction mechanism side) in an axial direction of a roller main body in the same embodiment.

The suction mechanism 73 suctions the gas collectively from the plurality of discharge apertures 72 and, as is shown in FIG. 4 in particular, is provided with a header portion 731 which is a stationary body provided so as to cover the discharge apertures 72 on the stationary side thereof, and a suction apparatus 732 that is connected to the header portion 731 and suctions the gas from inside the cavity portion X1 via the discharge apertures 72. Note that in the present embodiment, the header portion 731 and the suction apparatus 732 are connected together by a connecting pipe (i.e., a connecting duct) 734.

The header portion 731 is formed to have a substantially annular shape (see FIG. 3), and is provided so as to surround the journal shaft portion 222 and face towards an outer-side surface of the journal flange portion 221 in which the discharge apertures 72 are formed. A header space X2 is formed in a surface of the header portion 731 on a side thereof that faces towards the journal flange portion 221, and the header space X2 communicates with the plurality of discharge apertures 72. In addition, a connecting port P1 to which the connecting duct 734 is connected is formed in the header portion 731, and the header space X2 communicates with the connecting port P1.

In addition, this header portion 731 is supported via a bearing 91 so as to be stationary on an outer-side circumferential surface of the journal shaft portion 222. As a result, the header portion 731 is fixed to this stationary side so that the header portion 731 is unable to rotate with journal shaft portion 222. In addition, the header portion 731 is provided on the journal shaft portion 222 so as to be further toward the inner side in the axial direction than the stand 52.

The suction apparatus 732 suctions the gas from inside the cavity portion X1 via the header space X2 through the connecting port P1 of the header portion 731 and is formed, for example, by an electrically driven air pump or blower, or a suction pump or the like. This suction apparatus 732 is provided on the stationary side. An air exhaust duct (not shown in the drawings) is connected to an air exhaust port P2 of the suction apparatus 732, and the air exhaust port P2 of this air exhaust duct is disposed, for example, in an outside space (for example, outdoors) that is different from the space where the induction heated roll apparatus 100 is installed. Note that it is also possible to provide the suction apparatus 732 in the outside space, and to connect the suction apparatus 732 that is provided in the outside space to the connecting port P1 of the header portion 731 by means of the connecting duct 734. The suction apparatus 732 is formed such that a suction force thereof can be altered, for example, by changing the rotation speed thereof, and this enables the flow rate of the gas flowing through the cavity portion X1 to be adjusted. In addition to this, it is also possible to provide a flow rate adjustment mechanism such as a flow rate adjustment valve in the connecting duct 734.

The suction mechanism 73 of the present embodiment is additionally provided with a rotary sealing mechanism 733 that is interposed between the header portion 731 on the stationary side and the journal flange portion 221 on the rotating side. This rotary sealing mechanism 733 seals the header space X2 of the header portion 731 from the outside air. More specifically, the rotary sealing mechanism 733 provides a seal between an inner circumferential side of the header space X2 and an outer circumferential side thereof, and is formed, for example, by an annular sealing groove 733*a* that is formed in an outer-side surface of the journal flange portion 221, and a circular-cylinder shaped insertion portion 733*b* that is provided on a side circumferential wall of the header portion 731 and is inserted into the sealing groove 733*a*. Here, the rotary sealing mechanism 733 may be a contact sealing mechanism in order to provide complete isolation, or may be a non-contact sealing mechanism that permits the inflow of a slight amount of outside air.

Figure 5:
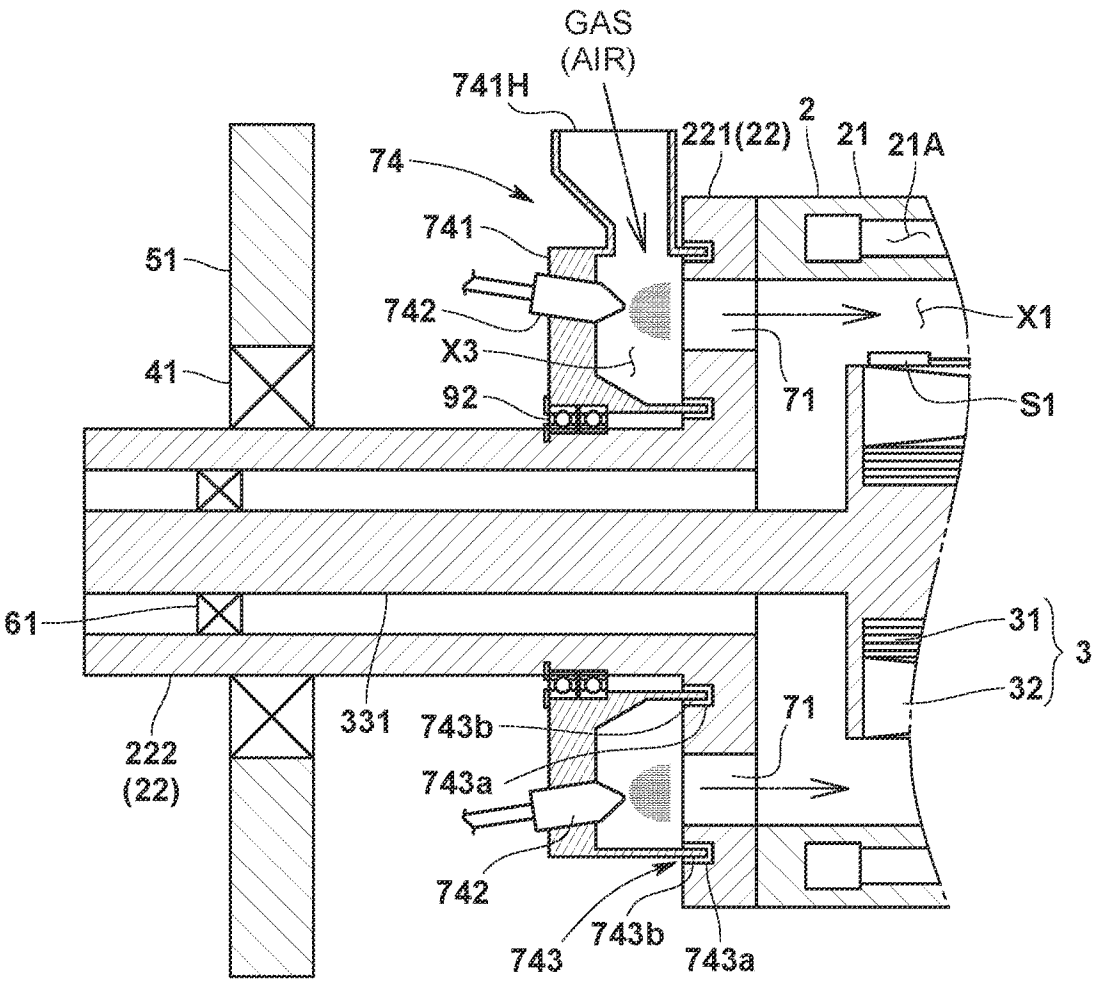
FIG. 5 is a cross-sectional view showing a structure of a first end side (i.e., a mist supply mechanism side) in the axial direction of the roller main body in the same embodiment.

The mist supply mechanism 74 supplies an atomized cooling medium (i.e., mist) to the plurality of intake apertures 71 and, as is shown in FIG. 5 in particular, is provided with a header portion 741 which is a stationary body that is provided so as to cover the intake apertures 71 on the stationary side, and mist generating apparatuses 742 that are provided in the header portion 741.

The header portion 741 is formed to have a substantially annular shape (see FIG. 2), and is provided so as to surround the journal shaft portion 222 and face towards an outer-side surface of the journal flange portion 221 in which the intake apertures 71 are formed. A header space X3 is formed in a surface of the header portion 741 on a side thereof that faces towards the journal flange portion 221, and the header space X3 communicates with the plurality of intake apertures 71.

In addition, an outside air intake aperture 741H that enables outside air to be introduced into the header space X3 is formed in the header portion 741. This outside air intake aperture 741H enables outside air to be introduced into the header space X3 as a result of the suction mechanism 73 suctioning out the gas in the cavity portion X1.

This header portion 741 is supported via a bearing 92 so as to be stationary on an outer-side circumferential surface of the journal shaft portion 222. As a result, the header portion 741 is fixed to this stationary side so that the header portion 741 is unable to rotate with journal shaft portion 222. In addition, the header portion 741 is provided on the journal shaft portion 222 so as to be further toward the inner side in the axial direction than the stand 51.

The mist generating apparatuses 742 supply mist to the intake apertures 71 by generating mist of a cooling medium (i.e., water) in the header space X3 of the header portion 741, and use, for example, injection valves (i.e., nozzles). FIG. 2 shows a structure in which two mist generating apparatuses 742 are provided; however, it is also possible for only one mist generating apparatus 742 to be provided, or for a mist generating apparatus 742 to be provided for each of the plurality of intake apertures 71. The greater the number of nozzles provided, the more efficiently can the mist be supplied to the intake apertures 71. Note that each mist generating apparatus 742 may be a one-fluid type of mist generating apparatus that generates mist by spraying compressed water from the nozzles, or may be a two-fluid type of mist generating apparatus that generates mist by spraying two fluids, namely, compressed water and compressed air from the nozzles. In addition, the mist generating apparatuses 742 are formed such that the amount of mist that is generated can be varied as a result of the quantity of water that is supplied to the nozzles being altered by a flow rate adjustment mechanism (for example, a flow rate control valve). As a consequence, the amount of mist that is supplied to the cavity portion X1 can be adjusted. Note that the flow rate adjustment mechanism is controlled by a control unit (not shown in the drawings). The cooling performance can be adjusted by this mist supply mechanism 74 at the same time as the flow rate of the gas flowing through the cavity portion X1 is kept constant.

The following can be considered as a specific example of how the mist supply rate is adjusted.

In the induction heated roll apparatus 100 of the present embodiment, a temperature sensor S1 is provided within the interior of the roller main body 2 in portions thereof that are adversely affected by condensation and dew formation of mist. These portions that are adversely affected by condensation and dew formation of mist include, for example, an upstream-side outer circumferential surface of the induction coil 32 (i.e., the outer circumferential surface thereof on the intake aperture 7 side), which is the most easily cooled portion thereof, and is the minimum temperature portion of the induction coil 32. In addition, the mist supply mechanism 74 adjusts the mist supply rate such that the dew point temperature of wet gas in the cavity portion X1 does not drop below the detected temperature detected by the temperature S1. More specifically, the mist supply mechanism 74 adjusts the mist supply rate in accordance with the detected temperature detected by the temperature S1, and adjusts this mist supply rate such that, for example, the dew point temperature of wet gas in the cavity portion X1 remains higher than the detected temperature detected by the temperature S1 by a predetermined temperature amount (for example, +2 degrees).

In order to even more reliably ensure that the dew point temperature does not drop below the detected temperature detected by the temperature sensor S1, it is also possible for the induction heated roll apparatus 100 to be provided with a humidity sensor that detects a relative humidity or an absolute humidity within the interior of the roller main body 2. In this case, the mist supply mechanism 74 adjusts the mist supply rate such that the dew point temperature of wet gas in the cavity portion X1, which is determined based on the detected humidity detected by the humidity sensor, does not drop below the detected temperature detected by the temperature sensor S1. In addition to this, it is also possible for the mist supply mechanism 74 to adjust the mist supply rate based on the flow rate of the gas flowing through the cavity portion X1.

The mist supply mechanism 74 of the present embodiment is additionally provided with a rotary sealing mechanism 743 that is interposed between the header portion 741 on the stationary side and the journal flange portion 221 on the rotating side. This rotary sealing mechanism 743 seals the header space X3 of the header portion 741 from the outside air in portions other than the outside air intake aperture. More specifically, the rotary sealing mechanism 743 provides a seal between an inner circumferential side of the header space X3 and an outer circumferential side thereof, and is formed, for example, by an annular sealing groove 743*a* that is formed in the outer-side surface of the journal flange portion 221, and a circular-cylinder shaped insertion portion 743*b* that is provided on a side circumferential wall of the header portion 741 and is inserted into the sealing groove 743*a*. Here, the rotary sealing mechanism 743 may be a contact sealing mechanism in order to provide complete isolation, or may be a non-contact sealing mechanism that permits the inflow of a slight amount of outside air.

In the above-described structure, when suctioning is begun by the suction apparatus 732, the gas inside the cavity portion X1 is suctioned out through the discharge apertures 72, and external gas surrounding the roller main body 2 is suctioned into the cavity portion X1 through the intake apertures 71. In addition, mist is supplied to the cavity portion X1 through the intake apertures 71. The mist that is supplied to the cavity portion X1 raises the humidity of the gas flowing in through the intake apertures so that, as a result, not only is the specific heat of the gas greatly improved, but when this mist comes into contact with the shell portion 21 of the roller main body 2 and the like, it is vaporized and captures the vaporization latent heat generated at this time from the shell portion 21. The gas suctioned in through the intake apertures 71 and unvaporized mist flow through the interior of the cavity portion X1 and are discharged through the discharge apertures 72.

Here, because both the intake apertures 71 and the discharge apertures 72 are formed in the journal flange portion 221, the gas and mist flowing through the interior of the cavity portion X1 do not flow between the journal shaft portion 222 and the supporting shafts 331 and 332, so that no limitations are placed thereon because of pressure loss between the journal shaft portion 222 and the supporting shafts 331 and 332. Moreover, because the bearings 62 are positioned further toward the outer side in the axial direction than the discharge apertures 72, high-temperature gas is discharged from the discharge apertures 72 before it can reach the bearing 62, so that any contact between this high-temperature gas and the bearing 62 can be avoided, and a reduction in the remaining lifespan of the bearing 62 can be inhibited.

Furthermore, in the present embodiment, processing such as the following is performed on portions contacted by external gas suctioned in through the intake apertures 71. Namely, an outer circumferential surface of the induction coil 32, which comes into contact with this external gas is covered by, for example, a polyimide-based, silicon-based, or epoxy-based heat-resistant insulating varnish. More specifically, a heat-resistant insulating varnish is coated onto the outer-side circumferential surface of the induction coil 32. In addition, an inner surface of the roller main body 2, which comes into contact with an external gas, is covered by a heat-resistant material. More specifically, heat-resistant paint or anti-corrosion paint is coated onto the inner surface of the roller main body 2. Alternatively, anti-corrosion plating processing may be performed on the inner surface of the roller main body 2.

Effects Obtained from the Present Embodiment

According to the induction heated roll apparatus 100 that is formed in the manner described above, because the intake apertures 71 are formed in the journal flange portion 221 on the first end side in the axial direction of the roller main body 2, gas entering via the intake apertures 71 flows through the intake apertures 71 into the cavity portion X1 in the first end portion in the axial direction of the roller main body 2 without passing through the cavity between the journal shaft portion 222 of the roller main body 2 and the supporting shaft 331 of the induction heating mechanism 3. In addition, because the discharge apertures 72 to which the suction mechanism 73 is connected are formed in the journal flange portion 221 on the other side in the axial direction of the roller main body 2, gas entering via the intake apertures 71 is discharged to the outside through the discharge apertures 72 in the second end portion in the axial direction of the roller main body 2 without passing through the cavity between the journal shaft portion 222 of the roller main body 2 and the supporting shaft 332 of the induction heating mechanism 3. Consequently, there are no limitations due to pressure loss in the cavity between the journal shaft portion 222 of the roller main body 2 and the supporting shafts 331 and 332 of the induction heating mechanism 3 in both end portions in the axial direction of the roller main body 2. As a result, it is possible to increase the flow rate of the gas flowing through the cavity portion X1, and to thereby improve the cooling performance.

Moreover, because mist is supplied to the intake apertures 71 formed in the journal flange portion 221, it is possible to shorten the route traveled by the mist to reach the shell portion 21 of the roller main body 2, and to thereby enable the mist to be introduced into the shell portion 21 of the roller main body 2 extremely efficiently. As a result, by raising the humidity of the gas flowing in through the intake apertures, it is possible to greatly improve the specific heat of the gas, and to also capture the vaporization latent heat from the shell portion 21 of the roller main body 2 extremely efficiently, so that the cooling performance is improved as a consequence.

In addition, because high-temperature gas that is heated as a result of flowing through the cavity portion X1 does not pass through the cavity between the journal shaft portion 222 of the roller main body 2 and the supporting shaft 332 of the induction heating mechanism 3, this high-temperature gas is prevented from coming into contact with the bearing 62 provided on the journal shaft portion 222, so that any reduction in the remaining lifespan of the bearing 62 is inhibited.

It should be noted that there may be cases in which a higher temperature load than the required operating temperature is generated in the roller main body 2 (i.e., the heated roll) so that the temperature of the roll increases even if the power supply is turned off. In such cases, it is difficult for high-accuracy temperature control to be achieved solely from cooling that is based on gas circulation. For this reason, a method of performing accurate control to achieve a desired temperature is employed in which circulation cooling that is slightly in excess of the heat input from the load is performed, and only an amount of heat that corresponds to this excess amount is input using induction heating. When control of this type is performed, it is effective if the quantity of cooling heat is controlled using the previously described air quantity adjustment.

Moreover, in cases in which a load operation is taking place even while a cooling operation is being performed, the uniformity of the temperature distribution of the shell portion 21 of the roller main body 2 is extremely important. Because the jacket chamber 21A inside which is sealed the gas-liquid two-phase heating medium is formed in the shell portion 21 of the roller main body 2, it is possible to improve the temperature uniformity in the axial direction of the shell portion 21 of the roller main body 2 during a cooling operation.

Furthermore, because a plurality of the discharge apertures 72 are formed in the journal flange portion 221 on the second end side in the axial direction, it is possible, while maintaining the mechanical strength of the journal portion and also lowering suction resistance, to suction gas and mist evenly from the circumferential direction of the cavity portion. In addition, because a plurality of the intake apertures 71 are formed in the journal portion 22 on the first end side in the axial direction, it is possible, while maintaining the mechanical strength of the journal portion 22 and also lowering gas intake resistance, to introduce gas and mist evenly in the circumferential direction of the cavity portion X1.

Additional Variant Embodiments

Note that the present invention is not limited to the above-described respective embodiments.

Figure 6:
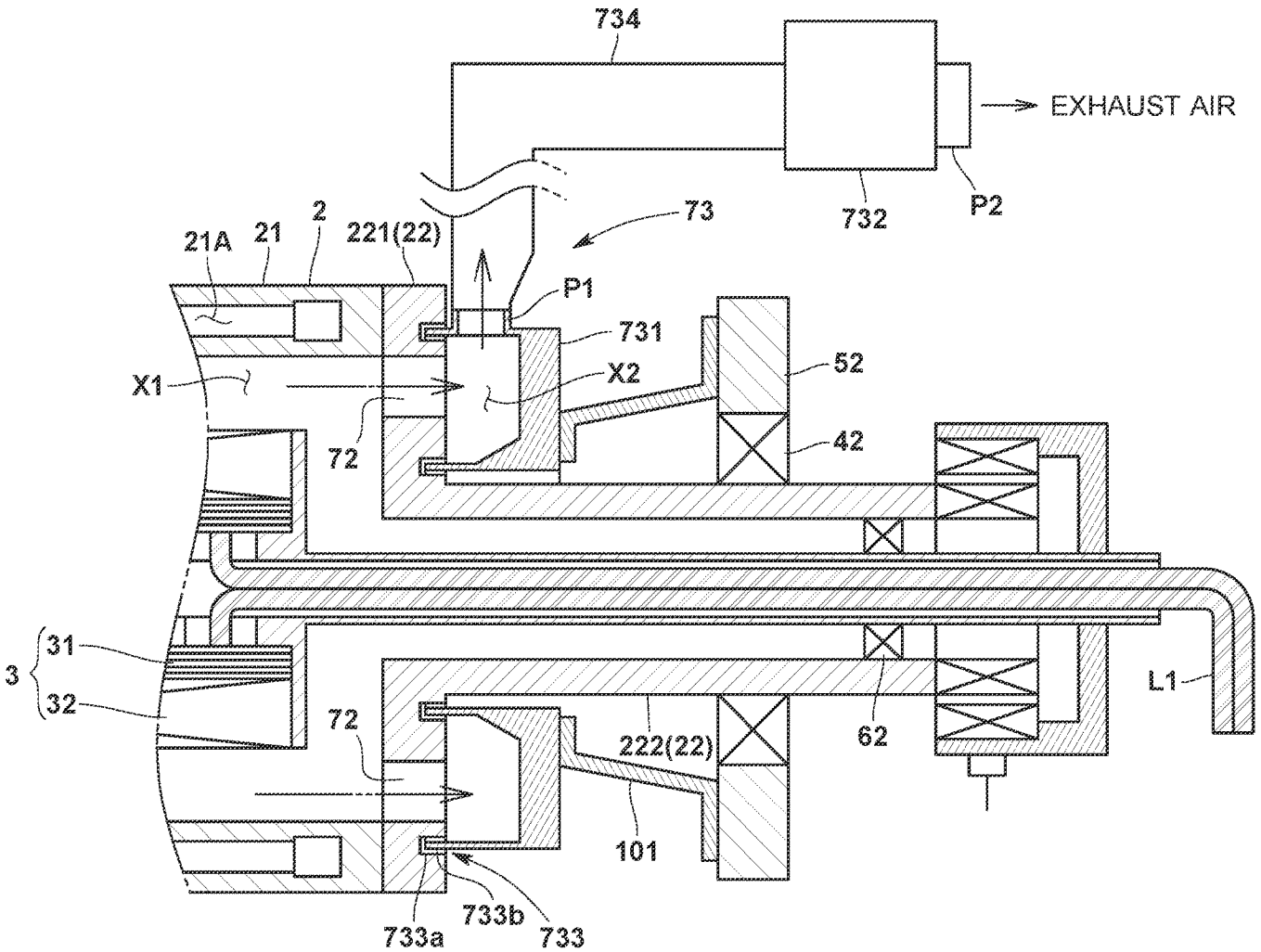
FIG. 6 is a cross-sectional view showing a fixing structure of a header portion of the suction mechanism in a variant embodiment.
Figure 7:
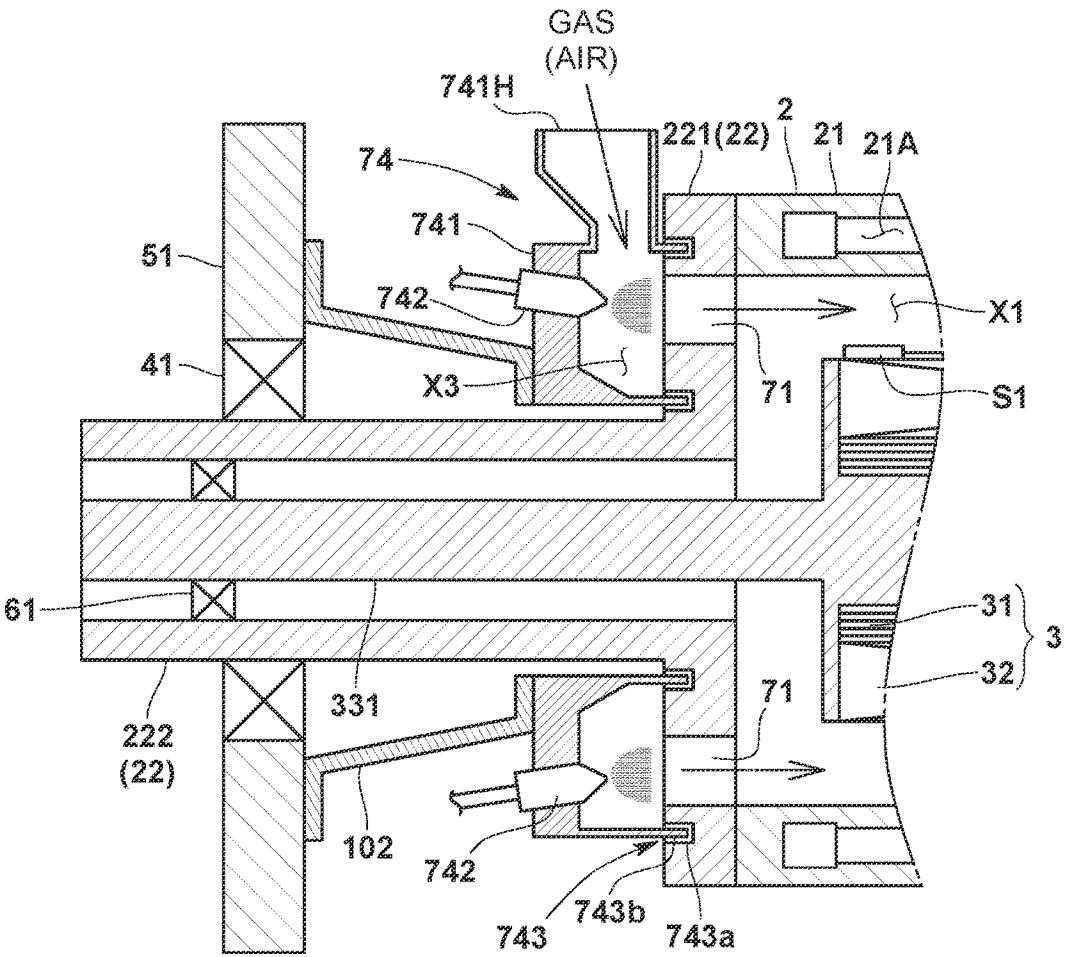
FIG. 7 is a cross-sectional view showing a fixing structure of a header portion of the mist supply mechanism in a variant embodiment.

For example, as is shown in FIG. 6 and FIG. 7, it is also possible to support the header portion 731 of the suction mechanism and/or the header portion 741 of the mist supply mechanism such that they remain stationary by fixing them to a stationary structural component that is provided separately from the roller main body 2. FIG. 6 and FIG. 7 show examples in which the header portions 731 and 741 are fixed via fixing components 101 and 102 to the bearings 41 and 42, which are stationary structural components, or to the stands 51 and 52; however, it is also possible to use other stationary structural components.

Figure 8A:
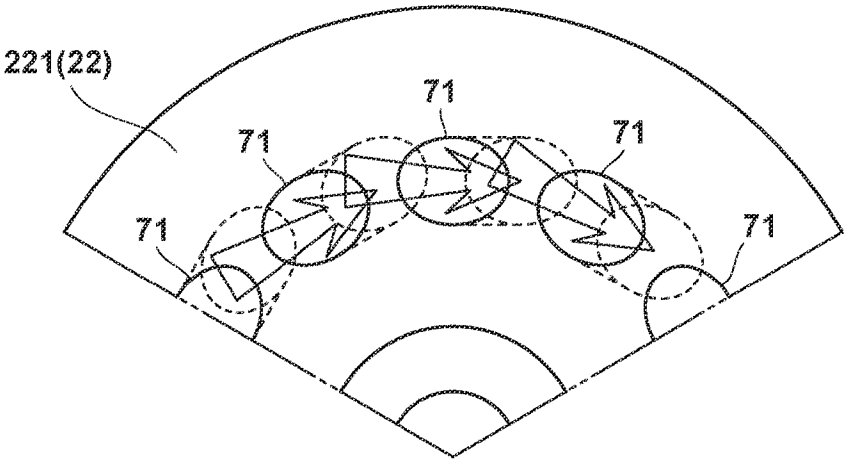
FIGS. 8A and 8B are schematic views showing a structure of intake apertures of a variant embodiment.
Figure 8B:
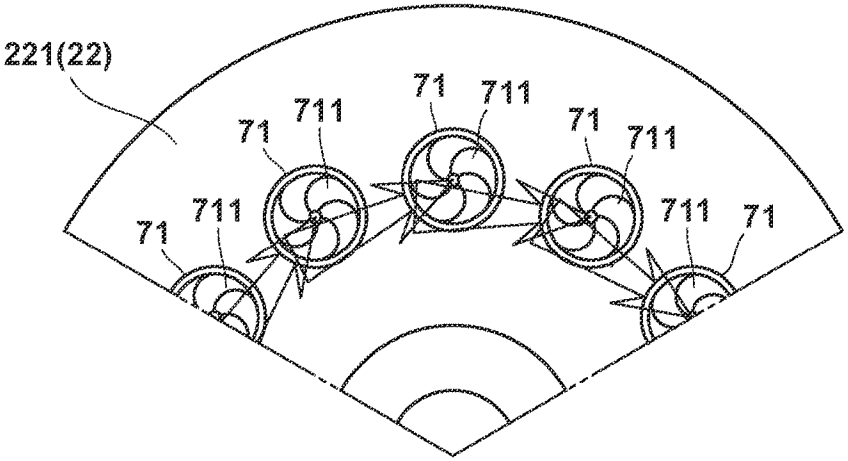

Furthermore, in order to promote turbulence in the cavity portion X1, it is also possible to provide a turbulence promoting structure in the intake apertures 71. For example, as is shown in FIG. 8A, consideration may be given to forming the intake apertures 71 such that they penetrate the journal flange portion 221 on an inclination in the circumferential direction thereof. In other words, intake apertures may be formed such that the outer-side apertures of the intake apertures and the inner-side apertures thereof are mutually offset in the circumferential direction. By employing this type of structure, gas introduced into the cavity portion X is made to flow in a swirling motion along the internal surface of the shell portion 21. Moreover, as is shown in FIG. 8B, it is also possible to provide blades 711 that promote turbulence in the intake apertures 71. By employing this type of structure, gas introduced into the cavity portion X is made to flow in a swirling motion multiple times in the circumferential direction.

In addition, it is also possible to use as the suction apparatus 732 a gas flow amplifier that receives a supply of compressed gas from a compressed gas source, and suctions gas through the discharge apertures. By employing this type of structure, in a case in which a compressed gas source already exists in the location where the induction heated roll apparatus 100 is installed, such as in a factory or the like, there is no need for a separate air pump or blower or the like to be provided.

Furthermore, it should be understood that the present invention is not limited to the above-described embodiments, and that various modifications and the like may be made thereto insofar as they do not depart from the spirit or scope of the present invention. If used herein, the phrase "and/or" means any or all of multiple stated possibilities.

DESCRIPTION OF THE REFERENCE NUMERALS

100 . . . Induction Heated Roll Apparatus
2 . . . Roller Main Body
21 . . . Shell Portion
221 . . . Journal Flange Portion
3 . . . Induction Heating Mechanism
X1 . . . Cavity portion
7 . . . Cooling Mechanism
71 . . . Intake Apertures
72 . . . Discharge Apertures
73 . . . Suction Mechanism
74 . . . Mist Supply Mechanism
741 . . . Header Portion
741H . . . Outside Air Intake Aperture
742 . . . Mist Generating Apparatuses
743 . . . Rotary Sealing Mechanism
92 . . . Bearing
S1 . . . Temperature Sensor

What is claimed is:

1. An induction heated roll apparatus comprising:
a roller main body having a hollow portion;
an induction heating mechanism that is provided inside the hollow portion, and that performs induction heating on the roller main body; and
a cooling mechanism that cools the roller main body and/or the induction heating mechanism using a cavity portion between the roller main body and the induction heating mechanism, wherein
the cooling mechanism comprises:
an intake aperture that is formed on a first end side in an axial direction of the roller main body and communicates with the cavity portion;
a discharge aperture that is formed on a second end side in the axial direction of the roller main body and communicates with the cavity portion;
a suction mechanism that suctions a gas in the cavity portion through the discharge aperture; and
a mist supply mechanism that supplies mist to the intake aperture,
the intake aperture is formed in a first journal flange portion on the first end side in the axial direction of the roller main body, and
the discharge aperture is formed in a second journal flange portion on the second end side in the axial direction of the roller main body, wherein
the mist supply mechanism comprises a header portion that is provided in such a way as to cover the intake aperture on a stationary side, and a mist generating device that is provided in the header portion,
the header portion comprises an outside air intake aperture that enables outside air to be introduced into a header space in the header portion,
the mist supply mechanism further comprises a rotary sealing mechanism that is interposed between the header portion and the first journal flange portion, and seals the header space off from the outside air in portions other than the outside air intake aperture, and
the mist generating device is provided with injection valves configured to generate mist of a cooling medium.

2. The induction heated roll apparatus according to claim 1, wherein
the intake aperture is one of a plurality of intake apertures formed in the first journal flange portion, and/or
the discharge aperture is one of a plurality of discharge apertures formed in the second journal flange portion.

3. The induction heated roll apparatus according to claim 1, wherein the header portion is supported via a bearing so as to be stationary on an outer-side circumferential surface of a journal shaft portion of the roller main body.

4. The induction heated roll apparatus according to claim 1, wherein the header portion is supported so as to be stationary by being fixed to a stand that is provided separately from the roller main body.

5. The induction heated roll apparatus according to claim 1, wherein the cooling mechanism adjusts a flow rate of the gas flowing through the cavity portion.

6. An induction heated roll apparatus comprising:
a roller main body having a hollow portion;
an induction heating mechanism that is provided inside the hollow portion, and that performs induction heating on the roller main body; and
a cooling mechanism that cools the roller main body and/or the induction heating mechanism using a cavity portion between the roller main body and the induction heating mechanism, wherein
the cooling mechanism comprises:
an intake aperture that is formed on a first end side in an axial direction of the roller main body and communicates with the cavity portion;
a discharge aperture that is formed on a second end side in the axial direction of the roller main body and communicates with the cavity portion;
a suction mechanism that suctions a gas in the cavity portion through the discharge aperture; and
a mist supply mechanism that supplies mist to the intake aperture, wherein
the intake aperture is formed in a first journal flange portion on the first end side in the axial direction of the roller main body,
the discharge aperture is formed in a second journal flange portion on the second end side in the axial direction of the roller main body, and
the mist supply mechanism adjusts a supply rate of the mist such that a dew point temperature of wet gas in the cavity portion does not drop below the temperature of a minimum temperature portion.

* * * * *